US005864793A

United States Patent [19]

Mesiwala et al.

[11] Patent Number: 5,864,793

[45] Date of Patent: Jan. 26, 1999

[54] PERSISTENCE AND DYNAMIC THRESHOLD BASED INTERMITTENT SIGNAL DETECTOR

[75] Inventors: Hakim M. Mesiwala, Cupertino, Calif.; Shawn R. McCaslin, Austin, Tex.

[73] Assignee: Cirrus Logic, Inc.

[21] Appl. No.: 693,374

[22] Filed: Aug. 6, 1996

[51] Int. Cl.[6] ..... G10L 3/02

[52] U.S. Cl. ..... 704/214; 704/211; 704/215

[58] Field of Search ..... 704/211, 214, 704/215, 224, 225

[56] References Cited

U.S. PATENT DOCUMENTS

| | | | |
|---|---|---|---|
| Re. 32,172 | 6/1986 | Johnston et al. | 381/46 |
| 3,377,428 | 4/1968 | Dersch | 179/1 |
| 3,946,157 | 3/1976 | Dreyfus | 179/1 SA |
| 4,052,568 | 10/1977 | Jankowski | 179/15 |
| 4,063,031 | 12/1977 | Grunza | 179/1 P |
| 4,158,750 | 6/1979 | Sakoe et al. | 179/1 SD |
| 4,223,180 | 9/1980 | Eckels | 179/1 SC |
| 4,535,473 | 8/1985 | Sakata | 381/46 |
| 4,627,091 | 12/1986 | Fedele | 381/46 |
| 4,672,669 | 6/1987 | DesBlache et al. | 381/46 |
| 4,688,256 | 8/1987 | Yasunaga | 381/46 |
| 4,696,031 | 9/1987 | Freudberg et al. | 379/386 |
| 4,696,041 | 9/1987 | Sakata | 381/46 |
| 4,700,392 | 10/1987 | Kato et al. | 381/46 |
| 4,811,404 | 3/1989 | Vilmur et al. | 381/94 |
| 4,821,325 | 4/1989 | Martin et al. | 381/46 |
| 4,897,832 | 1/1990 | Suzuki et al. | 370/81 |
| 4,975,657 | 12/1990 | Eastmond | 330/279 |
| 4,980,918 | 12/1990 | Bahi et al. | 395/2.49 |
| 4,982,427 | 1/1991 | Nicolai | 379/406 |
| 5,027,118 | 6/1991 | Nicolai | 341/132 |
| 5,159,638 | 10/1992 | Naito et al. | 381/46 |
| 5,267,322 | 11/1993 | Smith et al. | 381/107 |
| 5,276,765 | 1/1994 | Freeman et al. | 395/2 |
| 5,295,225 | 3/1994 | Kane et al. | 395/2.35 |
| 5,300,825 | 4/1994 | Inoue et al. | 307/351 |
| 5,369,791 | 11/1994 | Asghar et al. | 455/222 |
| 5,381,512 | 1/1995 | Holton et al. | 395/2.41 |
| 5,459,750 | 10/1995 | Hiotakakos et al. | 375/351 |
| 5,459,814 | 10/1995 | Gupta et al. | 395/2.42 |
| 5,507,037 | 4/1996 | Bartkowiak et al. | 455/296 |

*Primary Examiner*—David R. Hudspeth
*Assistant Examiner*—Michael N. Opsasnick
*Attorney, Agent, or Firm*—Robert Platt Bell; Steven A. Shaw

[57] ABSTRACT

A signal detector for detecting the presence of a intermittent signal component in a signal. The signal detector receives each of the signal strength samples during a corresponding iteration, and compares a threshold value with the received signal sample. The signal detector sets a counter to a pre-determined number if the sample compared is greater than the threshold value. The signal detector decrements the persistence counter if a corresponding sample is not greater than the threshold value. If the persistence counter is greater than a trigger value, the detector indicates the presence of a intermittent signal component or otherwise declares the absence of a intermittent signal component. The detector may indicate the presence of a intermittent signal component by a logical value of 1 and the absence by a logical value of 0. The threshold value is composed of two components; the intermittent signal component and the background signal component. Each of the components of the threshold is determined separately by using a tracker and a low pass estimator under a control signal obtained from previous decisions as to whether intermittent signal was present or absent.

27 Claims, 4 Drawing Sheets

PERSISTENCE AND DYNAMIC THRESHOLD BASED INTERMITTENT SIGNAL DETECTOR

FIELD OF THE INVENTION

The present invention relates generally to the field of signal processing and more specifically to a method and apparatus for detecting the presence of a voice component in a signal including voice and noise components.

BACKGROUND OF THE INVENTION

A device may detect the presence of a voice component in an input signal including both the voice component and a noise component. The voice component may include, for example, sound generated by a person when a person speaks, music, or other transient sounds (e.g., rustle of paper or other sound). The noise component may be generated, for example, as background noise (e.g., constantly present background sounds such as fan noise, road noise, and the like).

When a device detects that a voice component is present in an input signal, another circuit may process the input signal. Such a detection scheme may have application in several areas such as voice activation recording used in recording devices or in speech recognition where a detection function precedes a recognition function. For example, in a recording device, a detector device may detect the presence of a voice component in an input signal, and a recording circuit may record the input signal on a media when the detector device determines that voice component is present in the input signal.

Envelope-based signal detection is one prior art scheme for determining the presence of a voice component in an input signal as illustrated in FIG. 1. FIG. 1 includes a graph representing input signal 40 (illustrated as a solid line) along amplitude and time axis, and a corresponding envelope signal 20 (illustrated as a dashed line). If envelope signal 20 is at a level greater than a threshold level 10, a detector device may indicate that a voice component is present in input signal 40.

Input signal 40 may be characterized by periods of voice (illustrated during T2, T4, T6, T8, and T10 of FIG. 1), silence (illustrated during T1, T9, and T11), and non-silence gaps (T3, T5, and T7). Voice periods may correspond to a time period during which a voice component is present, as for example, when a person is speaking. Silence periods may be defined as absence of audible sound as experienced by a person or recording instrument, and may correspond to a time period when a speaker may in fact not be speaking.

Non-silence gaps are short duration periods without a voice component, which may be naturally present in between words or even within a word spoken by a person. Non-silence gaps may be of the order of fraction of a millisecond duration to a few milliseconds. In comparison, silence gaps may be much longer in duration. During both silence and non-silence gap periods (T1, T3, T5, T7, T9, and T11), noise component is illustrated in FIG. 1. As will be appreciated, during voice periods, input signal 40 may include a voice component super-imposed over a noise component.

It may be a requirement that envelope signal 20 remain at a high level during non-silence gap periods so as to enable a detector device to indicate that voice is present during non-silence gap periods. By so indicating, input signal 40 may be recorded (or otherwise processed) during non-silence gap periods also, which may result in accurate reproduction of voice captured in input signal 40. Without such recording of non-silence gaps, an audio sound reproduced may be inaccurate and sound unnatural.

To generate envelope signal 20 which remains at a high level during non-silence gap periods, a prior detector device may use components such as analog filters to generate envelope signal 20. As is well known in the art, envelope signal 20 generated by such detector devices may gradually decay in response to sudden reductions in instantaneous level of input signal 40. Thus during periods T3 and T5, envelope signal 20 remains high, and the detector device may indicate that a voice component is present during the corresponding periods.

However, the rate of decay may not be accurately related to the silence and non-silence gaps. Therefore if the decay is made too fast, non-silence gaps are detected as silence as illustrated during time T9. If the decay is made too small, the silence gaps may be missed and mis-identified as voice periods.

Moreover, such a detector device may not quickly respond to changes in input signal 40, envelope signal 20 may not rise to a sufficiently high level immediately when a voice component is present in input signal 40. As illustrated at input samples 70 of FIG. 1, envelope signal 20 may remain at a level lower than threshold level 10 for a short duration, and a detector device may accordingly miss indicating the presence of voice component in input signal 40.

Due to such misses, an audible voice reproduced from input signal 40 may not have acceptable quality as the leading portion of a word or words may be truncated. To avoid or minimize such misses, either the threshold 10 should be lowered or another prior art detector may be designed to respond quicker to changes in input signal 40. However, such changes could lead to falsely detecting background noise as voice.

SUMMARY OF THE INVENTION

A signal detector of the present invention indicates the presence of a desired component in an input signal. The input signal may also comprise a noise component. The signal detector may comprise a threshold value generator for generating a threshold value, and a thresholder with persistence for generating a decision signal corresponding to the input signal according to the method of the present invention.

The thresholder with persistence may comprise a comparator for comparing the threshold value to each of the plurality of samples in a plurality of successive iterations. A persistence counter may store a pre-determined persistence number if a first number of samples are greater than the threshold value. In a preferred embodiment, the first number may equal 1. A decrementor may decrement the persistence counter by a decrementing value each time one of the plurality of samples is not greater than the threshold value. An indicator may indicate that the desired component is present in the input signal when the persistence counter has a value greater than a trigger value. The desired component may be a voice component in the preferred embodiment.

The threshold value generator generates a threshold value for each of the plurality of successive iterations. The thresholder further comprises a controlled voice tracker for generating a first threshold component according to the voice component present in the input signal, and a controlled noise tracker generating a second threshold component according to the noise component present in the input signal. A scaled value of the first threshold component is added to a scaled value of the second threshold component to generate the threshold value which is provided to the thresholder during each of the iterations.

The controlled voice tracker of the present invention further comprises a selector for receiving as inputs an estimated level value for a previous iteration and one of the plurality of samples during a present iteration. The selector selects as a selected output one of the two inputs according to a selection control signal generated by a disabler. The disabler receives a signal indicative of whether the voice component was present in the input signal, and generates as the selection control signal a first value if the voice component was present and a second value if the voice component was not present. The disabler further generates a few second values in place of a corresponding number of first values corresponding to a first few indications of presence of a voice component. The controlled voice tracker maintains substantially the same threshold component value for a subsequent iteration if the disabler generates the second value.

The controlled voice tracker further comprises an exponential peak tracker for generating a level output and a decaying output. Both the level output and the decaying output are set equal to the input signal strength for the present iteration if the input signal strength is greater than or equal to a previous output scaled by a constant. The level output is set to the previous level output and the varying decaying output may be set to the last output times the constant if the input signal strength is less than the previous output scaled by a constant. A level estimator generates the estimated value of the voice component of the threshold from the level output.

A first delay element in the controlled voice tracker may buffer the estimated level value for a subsequent iteration and provides the estimated level value to the selector during a subsequent iteration. A second delay element delays the plurality of samples to the selector.

A gain amplifier couples the estimated level to the adder. The gain amplifier amplifies the estimated values to generate one threshold component for the plurality of iterations. A similar controlled noise tracker is used to estimate the second component of the threshold. In a preferred embodiment the gain amplifiers are designed such that the threshold value has a value of approximately six times the standard deviation of the plurality of samples corresponding to the noise component.

DETAILED DESCRIPTION OF THE INVENTION

The present invention is described herein in terms of various components for the purposes of clarity in understanding the invention. However, one of ordinary skill in the art would appreciate that such components may be implemented as software elements programming a general purpose or special purpose processor, or may be implemented in a programmable gate array, custom ASIC, analog circuit, or the like. In the preferred embodiment of the present invention, the elements described herein may be implemented in software used to program a digital signal processor.

Moreover, although the present invention is described in the context of voice detection, the apparatus and method of the present invention may also be applied to other types of signals, where a fairly continuous background component is present and an intermittent foreground component is to be distinguished from that background component.

The present invention is described in the context of signal detector 100 (illustrated in FIG. 3) which generates a decision signal indicative of the presence or absence of a voice component in an instantaneous input signal strength (IISS) 131 including continually present background noise component. Signal detector 100 maintains a persistence counter within Thresholder with Persistence 111, which is reset to a number greater than zero (for example, 2100) whenever IISS 131 has an instantaneous value greater than a threshold value. The persistence counter is decremented each time the instantaneous value of IISS 131 is less than the threshold value. The persistence counter may be decremented until the persistence counter value becomes a trigger value (for example, zero in the preferred embodiment).

Figure 2:
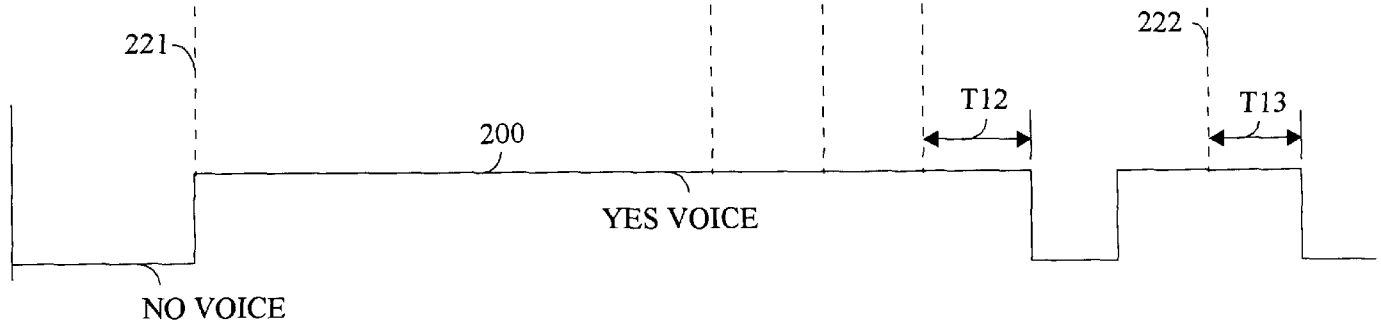
FIG. 2 is a graph illustrating the decision signal generated by the present invention.

When the persistence counter is greater than the trigger value, signal detector 100 may indicate (by a logical high value) that a voice component is present in IISS 131. When the persistence counter is equal to or less than the trigger value, signal detector 100 may indicate (by a logical low value) that a voice component is not present in IISS 131. The high and low logical values may together comprise decision signal 200 as illustrated in FIG. 2.

From the above, it will be appreciated that decision signal 200 is raised to a logical high value immediately upon the detection of an IISS sample having a value greater than a threshold value. As such a logical high value indicates the presence of a voice component, and as decision signal 200 is raised immediate to a high logical value, the apparatus of the present invention may reliably detect even short utterances of voice.

Also, decision signal 200 remains at a high logical value during a period determined by a value the persistent counter may be set to upon detection of an IISS sample having a value greater than a threshold value. By an appropriate choice of such a value, decision signal 200 may be generated to continue at a high logical value during non-silence gaps. As a result, signal detector 100 of the present invention may also reliably indicate the presence of a voice component during non-silence gap period T7.

In addition, signal detector 100 of the present invention dynamically computes the threshold value for each IISS sample based on prior IISS samples. Such a dynamic computation may provide for an accurate determination of whether an IISS sample comprises a voice component or noise component.

Although the present invention is described with reference to an IISS including voice and noise components, it will be appreciated that the present invention may be practiced with other types of IISSs having a desired component other than a voice component. For example, the present invention may be practiced with an IISS having a video component and a continually present noise component.

Figure 3:
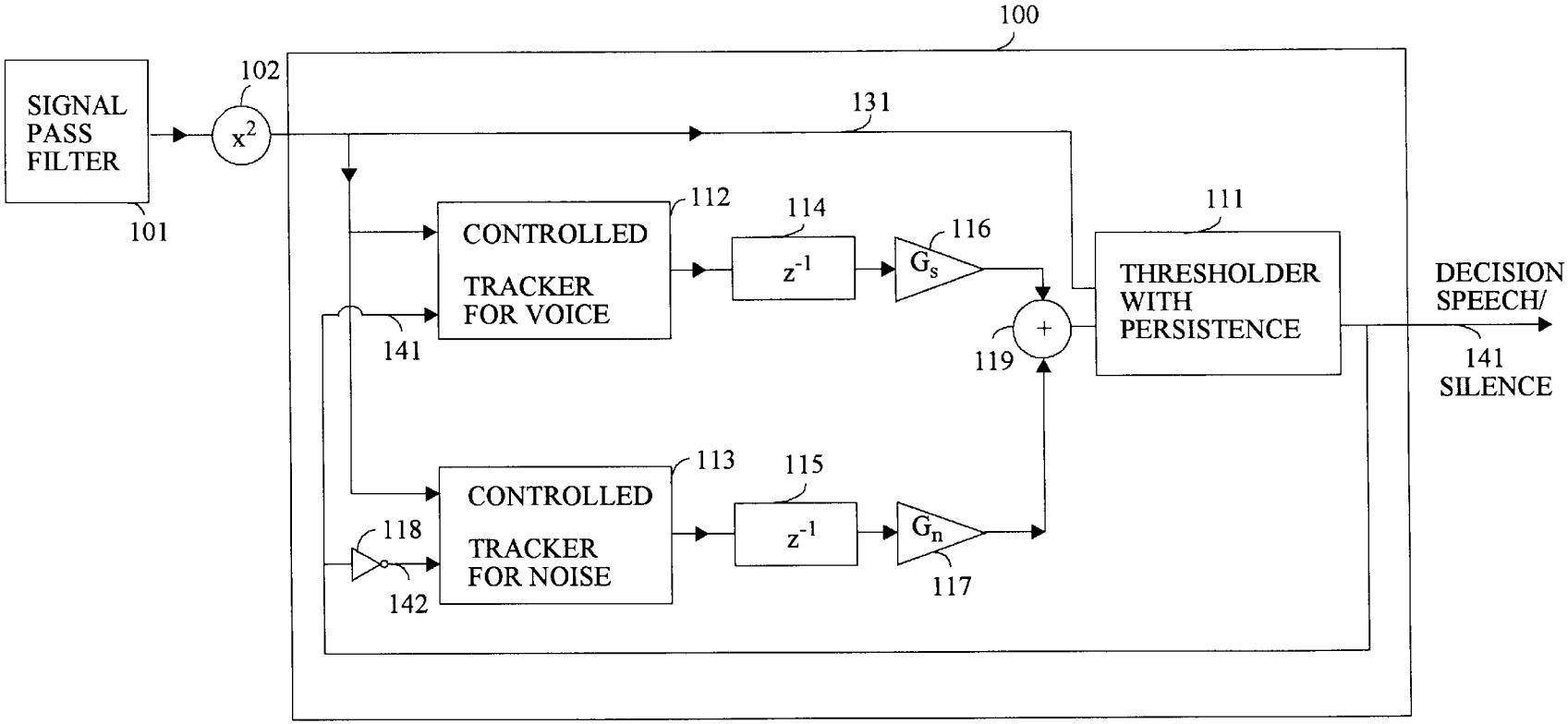
FIG. 3 is a block diagram of a signal detector of the present invention which detects the presence of a voice component in an input signal.

Referring to FIG. 3, signal-pass filter 101 receives a pre-processed input signal, and rejects the out-of-band-interest frequency portions from the signal. For example, signal-pass filter 101 may pass frequencies in the range of 300 to 3600 Hz, and reject the remaining frequencies. In a preferred embodiment, the signal pass filter is given by $H(z)=[(1+z^{-1})/2]^2$ and the pre-processed input signal may include a sequence of numbers representing a digitized signal.

Signal squarer 102 generates a square value of each sample of the signal received from signal-pass filter 101, and provides a rectified input signal on signal line 131. By squaring the samples, signal squarer 102 may accentuate the difference in values between voice component samples and noise component samples. In addition, squaring a signal serves to rectify the resulting output. An instantaneous input signal strength (IISS) including such squared values may be provided as an input signal to signal detector 100. Alternately, a rectifier may be used in place of signal squarer 102.

Referring now to FIGS. 2 and 3, signal detector 100 of the present invention generates decision signal 200. Decision signal 200 may have two logical values, a high logical value indicating the presence of a voice component and a low value indicating the absence.

As illustrated at times 221 and 222 in FIG. 2, decision signal 200 is risen to a high logical value without lagging a front portion of a desired component such as voice component present in IISS 131. However, as illustrated during periods T12 and T13, decision signal 200 may continue to be at a high logical value for a small duration even after the voice component ends. The duration of periods T12 and T13 is controlled by a value the persistent counter in signal detector 100 is set to when IISS 131 rises to a value above a threshold value.

Figure 4:
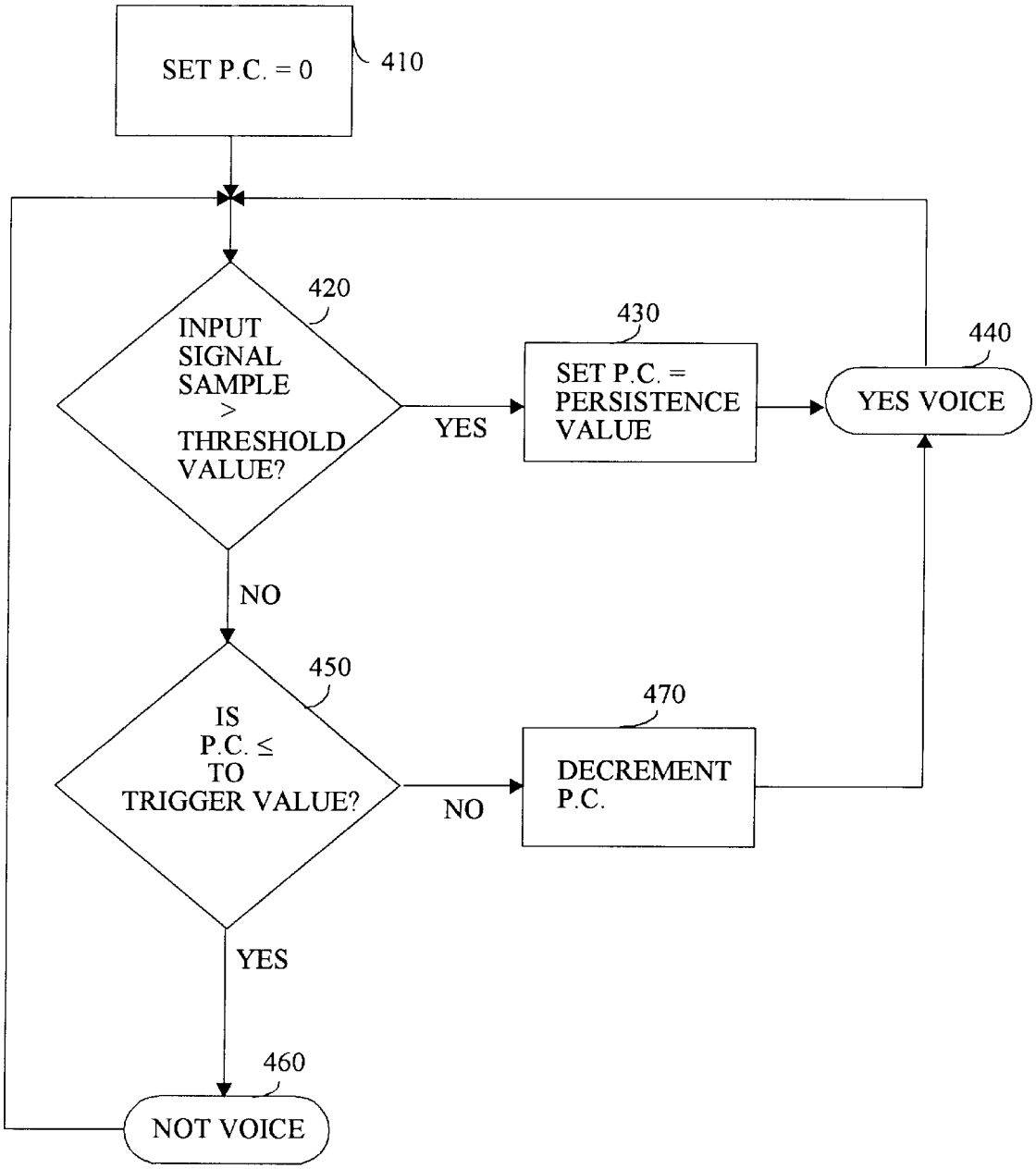
FIG. 4 is a flow-chart illustrating the steps performed by the detector of the present invention in generating a decision signal.

Thresholder with Persistence 111 of the present invention receives as input a threshold value from adder 119 and IISS on line 131, and generates decision signal 200 in accordance with the flow-chart of FIG. 4. In step 410, Thresholder with Persistence 111 sets a persistence counter (represented in the flow-chart as P.C.) to zero. The persistence counter may comprise a register within Thresholder with Persistence 111.

Figure 1:
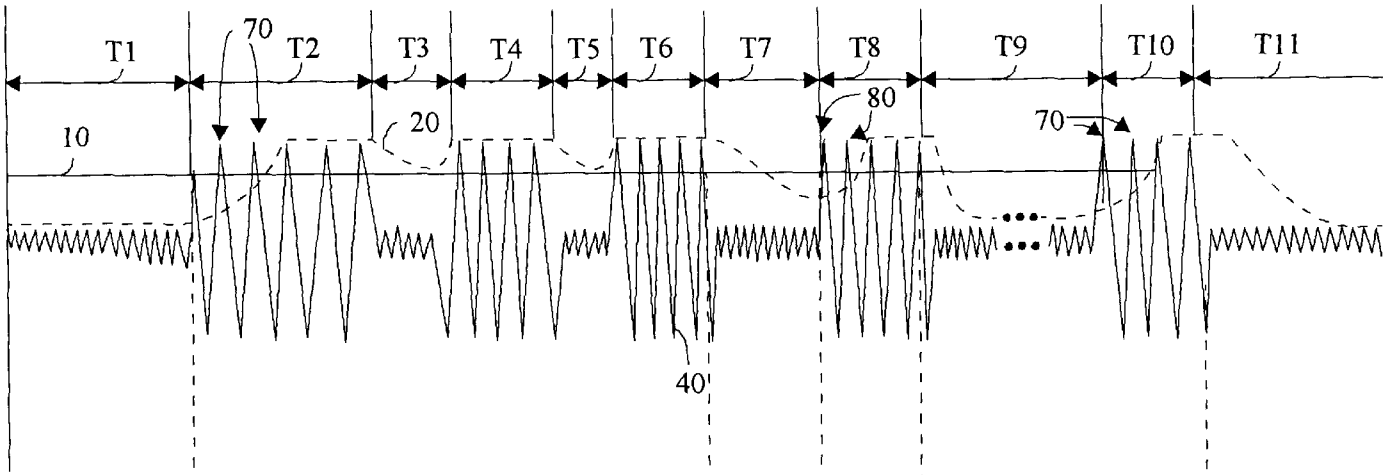
Fig. 1 (Prior Art)
FIG. 1 is a graph illustrating a prior art envelope signal corresponding to an input signal including a voice and a noise component.

In step 420, Thresholder with Persistence 111 compares a sample of IISS 131 with a threshold value received from adder 119. If an IISS sample is greater than the threshold value, Thresholder with Persistence 111 sets the persistence counter to a predetermined persistence value in step 430. The persistence value may be higher or lower depending upon the length of the period to be considered as a non-silence gap. Thus, by choosing a sufficiently high value, decision signal 200 remains at a high level even during long non-silence gaps such as during period T7 of FIGS. 1 and 2. In the preferred embodiment, the predetermined value is chosen to equal 2100 for an input signal sampled at 8 KHZ.

In step 440, Thresholder with Persistence 111 indicates that a voice component is present, and proceeds to process a next IISS sample in step 420 of a subsequent iteration. If an IISS sample is not greater than the threshold value, Thresholder with Persistence 111 compares the persistence counter with the trigger value in step 450. If the persistence counter is greater than the trigger value, Thresholder with Persistence 111 decrements persistence counter in step 470, and indicates that voice component is present in IISS 131 in step 440. However, if Thresholder with Persistence 111 determines that the value in the persistence counter is less than or equal to the trigger value in step 450, Thresholder with Persistence 111 indicates that no voice signal is present (by a low logical value) in step 460. In a preferred embodiment, the trigger value may have a value of zero.

Step 420 may be performed for each of the IISS samples. An IISS signal may therefore be processed in a plurality of successive iterations, with each iteration corresponding to a sample. From steps 420, 430, 450, 470, and 440, it will be appreciated that once IISS 131 is greater than a threshold value, Thresholder with Persistence 111 maintains decision signal 200 at a high logical value during a subsequent 2100 iterations even if IISS 131 does not contain a voice component in the corresponding period.

It will be appreciated that although the preferred embodiment of Thresholder with Persistence 111 resets the persistence counter upon detecting a single IISS sample with amplitude greater than a threshold value, it will be appreciated that the persistence counter may be reset only upon detecting a higher number of such IISS samples without departing from the scope and spirit of the present invention. For example, an alternate embodiment may examine an IISS for a predetermined number of input samples with amplitude greater than a threshold value, prior to resetting the persistence counter.

It may also be appreciated that by changing the polarity and sense of values, decision and functional blocks, same effect of decision on voice or no voice may be achieved. For example, the persistence value may be made negative and the counter may be incremented, instead of decrementing. The test for count may be lower than a trigger value rather than higher without departing from the spirit and scope of the present invention.

It may be further appreciated that the above precise control of persistence may be obtained by using other means, devices, or methods. For example, timers or one-shot circuits could be used instead of the counter illustrated in FIG. 4. Any means or method employed to obtain a precise amount of persistence and using the persistence so derived in controlling declaration of speech present or in deciding that certain gaps in speech are to be considered as speech are within the spirit and scope of the present invention.

Referring now to FIG. 3, signal detector 100 of the present invention provides for dynamically varying the threshold value which is generated by adder 119. Controlled Tracker for Voice 112, delay element 114, and amplifier 116 together generate a first threshold component. Controlled Tracker for Noise 113, delay element 115, and amplifier 117 together generate a second threshold component. Adder 119 adds the two threshold components to generate the threshold value, which is provided as an input to Thresholder with Persistence 111.

The outputs of controlled trackers 112 and 113 may be implemented using similar method and design. Therefore, only the details of Controlled Tracker for Voice 112 are discussed in the present application. However, input 142 to Controlled Tracker for Noise 113 is an inverted value of input 141 to Controlled Tracker for Voice 112.

More specifically, when Thresholder with Persistence 111 generates a logical value of 1 (to indicate that voice component is present), a logical value of 1 is provided on input 141, and a logical value of 0 is provided on input 142 due to the operation of inverter 118. The logical value of one on input 141 causes Controlled Tracker for Voice 112 to change the corresponding threshold component according to IISS received on input line 131.

A value of zero on input 142 causes controller tracker for noise 113 to maintain essentially the same threshold component value as computed before. However, if Thresholder with Persistence 111 generates a logical value of 0 as output, Controlled Tracker for Noise 113 recomputes the corresponding threshold component, and Controlled Tracker for Voice 112 maintains essentially the previous value of the threshold component.

Scalers 116 and 117 are designed to have gains of 0.05 and 1.5 respectively in a preferred embodiment. The gains may be set such that noise samples up to six times standard deviation of noise component are not detected as a voice component. It may be appreciated that the threshold may be changed from six times the standard deviation of the some other value without departing from the spirit and scope of the present invention. It will be further appreciated that by adding the first threshold component (which is generated based on voice component signal), signal detector 100 of the present invention ensures that the threshold value is greater than a certain minimum value even if noise component is negligible in the IISS.

Figure 5:
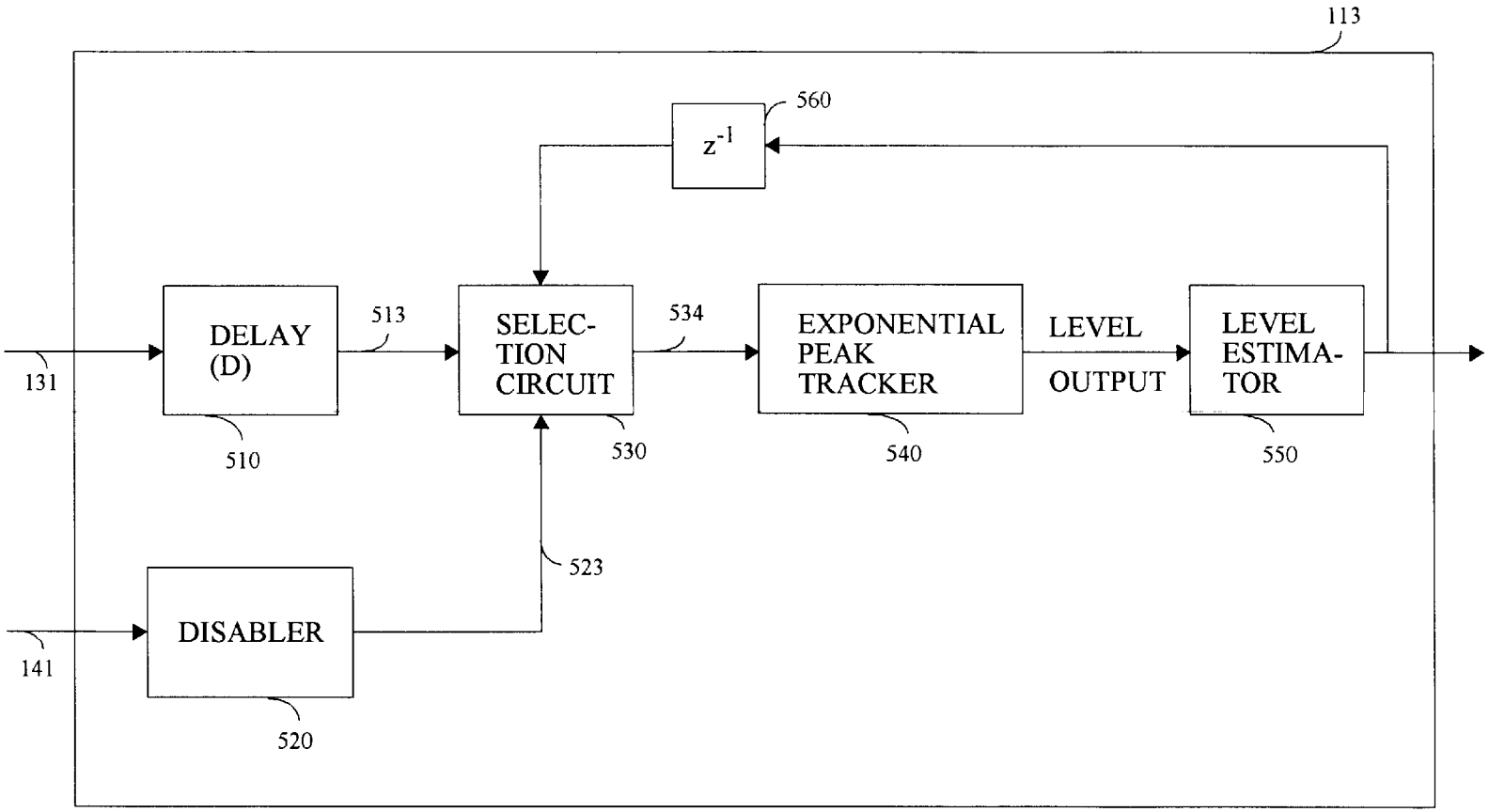
FIG. 5 is a block diagram illustrating the details of the threshold component generator of the present invention.

FIG. 5 is a block diagram illustrating the details of controlled trackers 112 and 113. Selector 530 receives as inputs a delayed IISS from delay element 510 and a previous iteration estimated level from delay element 560, and selects as output 534 one of the two inputs according to a value on select signal 523. If select signal 523 has a logical value of 0, selector 530 selects as output the previous iteration estimated level. If select signal 523 has a logical value of 1, selector 530 selects the delayed IISS.

Disabler 520 receives an enabling input on input 141. The enabling input has a logical value of 1 when Thresholder with Persistence 111 determines that a voice component is present in an IISS. Disabler 520 generally forwards the enabling input on select signal 523. However, if a logical value of 1 is received after a zero, disabler 520 disables the first D successive ones, and forwards logical value of 0 instead. D may be an integer having a value 0 or more.

Due to such disabling, selector 530 may continue to receive logical values of 0 in place of a first few ones received on input 141. In response, selector 530 may ignore IISS samples corresponding to the zeros received. The threshold component may remain essentially unchanged during the iterations corresponding to each of the zeros.

The output of exponential peak tracker 540 produces two outputs, a level output and a decaying output. If the sample fed from selector 530 is greater than or equal to previous decaying output scaled by a constant, the output in both the level output and the decaying output is equal to the sample from selector 530. Otherwise, the level output may be set to previous level output, and the varying decaying output may be last output times the constant. In a preferred embodiment, the constant may have a value of (1-fractional loss). Fractional loss may have a value of (1/500) in a preferred embodiment. The level output feeds estimator 550.

It may be appreciated that a linear or other form of peak tracker may be substituted instead of an exponential peak tracker without departing from the spirit and scope of the present invention.

Estimator 550 may generate an estimated next threshold component using a predetermined scheme. In a preferred embodiment, estimator 550 comprises a low-pass filter represented by the function: $(1-a)^2 \times (1+z^{-1})^2/(1-az^{-1})^2$, wherein 'x' represents a multiplication operation, and 'a' is a constant. In a preferred embodiment, constant 'a' may have a value of (1½000).

Delay element 560 may store the estimated level value generated by estimator 550, and provide the value to selector 530 in a subsequent iteration. When enable input received on input 141 is a zero, the previously estimated value may be circulated in exponential tracker 540.

It will be appreciated from the above description that a user may have considerable control over the threshold value sent to Thresholder with Persistence 111 by choosing a suitable design of estimator 550 and exponential peak tracker 540.

Although the present invention has been illustrated and described in detail, it is clearly understood that the same is by way of illustration and example only and is not to be taken by way of limitation, the scope and spirit of the present invention being limited only the terms of the appended claims.

What is claimed is:

1. A signal detector for distinguishing between continuous silence and non-silence speech gaps in a signal, the signal comprising an intermittent speech component and a continuously present background signal component, wherein continuous silence comprises the background signal component between speeches, and non-silence speech gaps comprises background signal components between individual words or syllables of a speech, the signal detector comprising:

a threshold value generator for generating a threshold value representing a demarcation between a level of the intermittent speech component and the continuously present background signal component; and a thresholder with persistence coupled to said threshold value generator, said thresholder with persistence comparing the threshold value to signal strength of the signal to determine whether the speech component is present in said signal; wherein the signal strength comprises a series of signal strength samples, and said thresholder generates a threshold value for the series of signal strength samples based upon prior signal strength samples in the series of signal strength samples, said thresholder with persistence including:

a comparator coupled to the threshold value generator for comparing the threshold value to each of the series of signal strength samples in a series of successive iterations;

a persistence counter for storing a predetermined number if a first number of signal strength samples are greater than the threshold value;

a decrementor for decrementing the persistence counter by a decrementing value when a sample is less than the threshold value; and an indicator, coupled to the persistence counter for indicating that the desired component is present in the signal when the persistence counter has a value greater than a trigger values, wherein the predetermined number stored in the persistence counter is set to a number of samples greater than contained in a non-silence speech gap such that the persistence counter will not reach the trigger value during a non-silence speech gap.

2. A signal detector for indicating the presence of a desired component in a signal, the signal comprising an intermittent desired component and a continuously present background signal component, the signal detector comprising:

a threshold value generator for generating a threshold value, said threshold value generator comprising:

an intermittent signal tracker for generating an intermittent signal threshold component according to the intermittent signal component present in said signal, a background signal tracker for generating a background signal threshold component according to the background signal component present in the signal, a first scaling element, coupled to said intermittent signal, for scaling the intermittent signal component and outputting a scaled intermittent signal threshold component, a second scaling element, coupled to said background signal tracker, for scaling the background signal threshold component and outputting a scaled background signal threshold component, and an adder, coupled to said first scaling element and said second scaling element, for adding the scaled intermittent signal threshold component and the scaled background signal threshold component to generate a threshold value, and a thresholder coupled to said threshold value generator, said thresholder comparing the threshold value to signal strength of the signal to determine whether the desired component is present in said signal.

3. A signal detector indicating the presence of a desired component in a signal, the signal comprising an intermittent desired component and a continuously present background signal component, the signal detector comprising:

a threshold value generator for generating a threshold value; and a thresholder with persistence coupled to said threshold value generator, said thresholder with persistence comparing the threshold value to signal strength of the signal to determine whether the desired component is present in said signal; wherein the signal strength comprises a series of signal strength samples, and said thresholder generates a threshold value for the series of signal strength samples based upon prior signal strength samples in the series of signal strength samples, said thresholder with persistence including:

a comparator coupled to the threshold value generator for comparing the threshold value to each of the series of signal strength samples in a series of successive iterations;

a persistence counter for storing a pre-determined number if a first number of signal strength samples are greater than the threshold value;

a decrementor for decrementing the persistence counter by a decrementing value when a sample is less than the threshold value; and an indicator, coupled to the persistence counter for indicating that the desired component is present in the signal when the persistence counter has a value greater than a trigger value;

wherein said threshold value generator further comprises:

an intermittent signal tracker for generating an intermittent signal threshold component according to the intermittent signal component present in said signal;

a background signal tracker for generating a background signal threshold component according to the background signal component present in the signal; and an adder, coupled to said intermittent signal tracker and said background signal tracker, for adding the intermittent signal threshold component and the background signal threshold component to generate the threshold value to said thresholder during each of the iterations, wherein said threshold value generator further comprises:

a first scaling element, coupled to said intermittent signal and said adder, for scaling the intermittent signal component and outputting a scaled intermittent signal threshold component to the adder; and a second scaling element, coupled to said background signal tracker and said adder, for scaling the background signal threshold component and outputting a scaled background signal threshold component to the adder, wherein the background signal tracker further comprises:

a selector for receiving as inputs an estimated level value for a present iteration and one of the series of signal strength samples during an iteration, said selector selecting as a selected output one of the two inputs according to a selection control signal; and a disabler coupled to said selector, said disabler receiving a signal indicative of whether the intermittent signal component was present in said signal, said disabler generating as the selection control signal a first value if the intermittent signal component was present and a second value if the intermittent signal component was not present, said disabler further generating at least one first value in place of corresponding second values to delay estimation of the background signal threshold component due to background signal then present, wherein the background signal tracker maintains substantially the same threshold component value for a subsequent iteration if the signal indicates that the intermittent signal component is present in the signal.

4. The signal detector of claim 3 wherein the background signal tracker further comprises:

an exponential peak tracker for generating a level output and a decaying output, wherein both the level output and the decaying output are equal to the instantaneous input signal strength fed to the peak tracker for the present iteration and the instantaneous signal strength fed to the peak tracker is greater than or equal to a previous decaying output scaled by a constant, and wherein the level output is set to the previous level output and the varying decaying output comprises a last output times the constant if the instantaneous signal strength fed to the peak tracker is less than the previous decaying output scaled by a constant;

an estimator for generating the estimated value for a subsequent iteration; and a first delay element for buffering the estimated value for a subsequent iteration and providing the estimated value to said selector during a subsequent iteration.

5. The signal detector of claim 4 wherein the background signal tracker further comprises a second delay element for delaying the series of signal strength samples to said selector.

6. The signal detector of claim 5, wherein said background signal tracker further comprises a scaler coupled to said adder, said scaler amplifying the estimated values to generate the background signal threshold components for the series of iterations.

7. The signal detector of claim 6 wherein the intermittent signal tracker comprises:

a selector for receiving as inputs an estimated level value for a present iteration and one of the series of signal strength samples during an iteration, said selector selecting as a selected output one of the two inputs according to a selection control signal; and a disabler, coupled to said selector, said disabler receiving a signal indicative of whether the intermittent signal component was present in said signal, said disabler generating as the selection control signal a first value if the intermittent signal component was present and as second value of the intermittent signal component was not present, said disabler further generating at least one second value in place of corresponding first values to delay estimation of the intermittent signal threshold component due to intermittent signal component present then, wherein the intermittent signal tracker maintains substantially the same threshold component value for a subsequent iteration of the signal indicates that the intermittent signal component is absent in the signal.

8. The signal detector of claim 7 wherein the intermittent signal tracker further comprises:

an exponential peak tracker for generating a level output and a decaying output, wherein both the level output and the decaying output are equal to the instantaneous signal strength fed to the peak tracker for the present iteration and the instantaneous signal strength fed to the peak tracker is greater than or equal to a previous decaying output scaled by a constant, and wherein the level output is set to the previous level output and the varying decaying output comprises a last output time the constant if the instantaneous signal strength fed to the peak tracker is less than the previous decaying output scaled by a constant;

an estimator for generating the estimated value for a subsequent iteration; and a first delay element for buffering the estimated value for a subsequent iteration and providing the estimated value to said selector during a subsequent iteration.

9. The signal detector of claim 8, wherein the intermittent signal tracker further comprises a second delay element for delaying the series of signal strength samples to said selector.

10. The signal detector of claim 9, further comprising a scaler coupled to said adder, said scaler amplifying the estimated values to generate the intermittent signal threshold components for the series of iterations.

11. The signal detector of claim 9, wherein the threshold value due to both background and intermittent signal components has a value of six times the standard deviation of the series of samples corresponding to the background signal component.

12. The signal detector of claim 11, further comprising a signal pass filter for rejecting high frequencies from the signal, and a squarer for squaring each of the series of signal strength samples.

13. A threshold value generator for generating a threshold value for each of a series of successive iterations, wherein a detector compares each of a series of signal strength samples in a signal with the threshold value to determine the presence of an intermittent signal component in the signal, the signal comprising an intermittent signal component and a background signal component, the threshold value generator comprising:

an intermittent signal tracker for generating a one threshold component according to the intermittent signal component present in said signal;

a first scaling element, coupled to said intermittent signal tracker, for scaling the one threshold component and outputting the scaled one threshold component;

a background signal tracker for generating another threshold component according to the background signal component present in said signal; and a second scaling element, coupled to said background signal tracker, for scaling the another threshold component and outputting the scaled another threshold component; and an adder coupled to said first scaling element and said second scaling element, said adder adding the scaled one threshold component and the scaled another threshold component to generate the threshold value, said adder providing the threshold value to said detector during each of the iterations.

14. A threshold value generator for generating a threshold value for each of a series of successive iterations, wherein a detector compares each of a series of signal strength samples in a signal with the threshold value to determine the presence of an intermittent signal component in the signal, the signal comprising an intermittent signal component and a background signal component, the threshold value generator comprising:

an intermittent signal tracker for generating a one threshold component according to the intermittent signal component present in said signal;

a first scaling element, coupled to said intermittent signal tracker for scaling the one threshold component and outputting the scaled one threshold component;

a background signal tracker for generating another threshold component according to the background signal component present in said signal;

a second scaling element, coupled to said background signal tracker, for scaling the another threshold component and outputting the scaled another threshold component; and an adder coupled to said first scaling element and said second scaling element, said adder adding the scaled one threshold component and the scaled another threshold component to generate the threshold value, said adder providing the threshold value to said detector during each of the iterations;

wherein the background signal tracker comprises:

a selector for receiving as inputs an estimated level value for a present iteration and one of the series of signal strength samples during an iteration, said selector selecting as a selected output one of the two inputs according to a selection control signal; and a disabler coupled to said selector, said disabler receiving a signal indicative of whether the intermittent signal component was present in said signal, said disabler generating as the selection control signal a first value if the intermittent signal component was present and a second value if the intermittent signal component was not present, said disabler further generating at least one first value in place of corresponding second values to delay estimation of the background signal threshold component due to the intermittent signal component present at that time, wherein the background signal tracker maintains substantially the same threshold component value for a subsequent iteration if the signal indicates that the intermittent signal component is present in the signal.

15. The threshold value generator of claim 14, wherein the background signal tracker further comprises:

an exponential peak tracker for generating a level output and a decaying output, wherein both the level output and the decaying output are equal to the instantaneous signal strength fed to the peak tracker is greater than or equal to a previous decaying output scaled by a constant, and wherein the level output is set to the previous level output and the varying decaying output comprises a last output times the constant if the instantaneous signal strength fed to the peak tracker is less than the previous decaying output scaled by a constant;

an estimator for generating the estimated value for a subsequent iteration; and a first delay element for buffering the estimated value for a subsequent iteration and providing the estimated value to said selector during a subsequent iteration.

16. The threshold value generator of claim 15, wherein the background signal tracker further comprises a second delay element for delaying the series of signal strength samples to said selector.

17. The threshold value generator of claim 16, wherein the intermittent signal tracker comprises:

A selector for receiving as inputs as estimated level value for a present iteration and one of the series of signal strength samples during an iteration, said selector selecting as a selected output one of the two inputs according to a selection control signal; and a disabler, coupled to said selector, said disabler receiving a signal indicative of whether the intermittent signal component was present in said signal, said disabler generating as the selection control signal a first value if the intermittent signal component was present and a second value of the intermittent signal component was not present, said disabler further generating at least one second value in place of corresponding first values to delay estimation of the intermittent signal threshold component due to the intermittent signal component being present during that time, wherein the intermittent signal tracker maintains substantially the same threshold component value for a subsequent iteration if the signal indicates that the intermittent signal component is absent in the signal.

18. The threshold value generator of claim 17, wherein the intermittent signal tracker further comprises:

an exponential peak tracker for generating a level output and a decaying output, wherein both the level output and the decaying output are equal to the instantaneous signal strength fed to the peak tracker for the present iteration and the instantaneous signal strength fed to the peak tracker is greater than or equal to a previous decaying output scaled by a constant, and wherein the level output is set to the previous level output and the varying decaying output comprises a last output times the constant if the instantaneous signal strength fed to the peak is less than the previous decaying output scaled by a constant;

an estimator for generating the estimated value for a subsequent iteration; and a first delay element for buffering the estimated value for a subsequent iteration and providing the estimated value to said selector during a subsequent iteration.

19. The threshold value generator of claim 18 wherein the intermittent signal tracker further comprises a second delay element for delaying the series of signal strength samples to said selector.

20. A method for generating a decision signal corresponding to an instantaneous signal strength, wherein said instantaneous signal strength comprises a series of samples, the signal comprising a background signal component and an intermittent signal component, the method comprising the steps of:

generating a threshold value corresponding to each of the series of signal strength samples;

comparing each of the series of signal strength samples with a corresponding threshold value during a corresponding one of a series of successive iterations;

setting a persistence counter to a predetermined value for at least a predetermined amount of time if the sample compared is greater than the threshold value;

decrementing the persistence counter by a decrementing value if the sample compared is not greater then the threshold value;

generating a first signal level when the persistence counter has a value greater than a trigger value, and a second signal level if the persistence counter has a value less than or equal to the trigger value, wherein the first signal level and the second signal level together comprise the decision signal.

21. The method of claim 20 wherein the step of generating a threshold value further comprises the steps of:

generating an intermittent signal threshold component according to the intermittent signal component present in said signal;

generating a background signal threshold component according to the background signal component present in said signal; and adding the intermittent signal threshold component and the background signal threshold component to generate the threshold value.

22. The method of claim 21 wherein the step of generating a background signal threshold component further comprises the steps of:

generating an estimated value for one of a successive iterations based on an input;

in a subsequent iteration, selecting either the estimated value generated in the above step of generating an estimated value or the sample for the subsequent iteration;

providing the selected value as the input to a level estimator to estimate a level value; and generating a component of the threshold value by amplifying the estimated value.

23. The method of claim 21 wherein the step of generating a intermittent signal threshold component further comprises the steps of:

generating an estimated value for one of a successive iterations based on an input;

in a subsequent iteration, selecting either the estimated value generated in the above step of generating an estimated value or the sample for the subsequent iteration;

providing the selected value as the input to a level estimator to estimate a level value; and generating a component of the threshold value by amplifying the estimated value.

24. A method for precisely distinguishing between non-silence speech gaps and silence by dynamic threshold and persistence, comprising the steps of:

receiving an input signal;

sampling the input signal as a plurality of digital signal samples;

generating an instantaneous input signal strength value for each of said plurality of digital signal samples;

comparing a component of the instantaneous input signal strength with a threshold value to determine whether speech is present in the input signal;

maintaining a speech output indication signal for a predetermined period of time if it is determined speech was present; and feeding back past speech presence determination to enable or disable generating and updating a threshold value, wherein the threshold value is dynamically adjusted in response to levels of speech and background signal components in said input signal.

25. The method of claim 24, wherein said step of comparing a component of an input signal value with a threshold value comprises the step of comparing the instantaneous input signal strength with a threshold value to determine whether speech is present in the input signal.

26. The method of claim 25, wherein said step of maintaining a speech output indication signal for a predetermined period of time if the input value is greater than the threshold value comprises the steps of:

setting a counter at a predetermined value if speech is detected if speech is detected in said comparing step;

decrementing the counter for each successive sample if signal strength is below a threshold until a trigger value is reached; and outputting a speech detection signal for each input signal sample if the counter is at a value higher than the trigger value.

27. The method of claim 26, wherein said step of feeding back past speech presence determinations to enable and disable generating and updating a new threshold value further comprises the steps of:

sampling an instantaneous input signal strength value for a previous signal sample determined to be speech;

tracking the instantaneous input signal strength value for a previous signal sample determined to be speech using an exponential peak tracker and outputting a first tracked value;

scaling the first tracked value output from the exponential peak tracker to produce a first scaled value;

sampling an instantaneous input signal strength value for a previous signal sample determined to be silence;

tracking the instantaneous input signal strength value for a previous signal sample determined to be silence using an exponential peak tracker and outputting a second tracked value;

scaling the second tracked value output from the exponential peak tracker to produce a second scaled value; and adding the first and second scaled tracked values to produce a new threshold value.

* * * * *